US008740422B2

(12) United States Patent
Tanaka et al.

(10) Patent No.: US 8,740,422 B2
(45) Date of Patent: Jun. 3, 2014

(54) BULB AND LUMINAIRE

(75) Inventors: Toshiya Tanaka, Yokosuka (JP); Kozo Ogawa, Yokosuka (JP); Yoshihiro Nomura, Yokosuka (JP); Kunihiko Ikada, Yokosuka (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 0 days.

(21) Appl. No.: 13/598,756

(22) Filed: Aug. 30, 2012

(65) Prior Publication Data

US 2013/0100683 A1 Apr. 25, 2013

(30) Foreign Application Priority Data

Oct. 25, 2011 (JP) ..... 2011-233747

(51) Int. Cl.
*F21V 29/00* (2006.01)

(52) U.S. Cl.
USPC ..... 362/373; 362/265; 362/294

(58) Field of Classification Search
USPC ..... 362/218, 264, 265, 294, 373
See application file for complete search history.

(56) References Cited

U.S. PATENT DOCUMENTS

| | | | | |
|---|---|---|---|---|
| 7,637,635 | B2 * | 12/2009 | Xiao et al. | 362/218 |
| 8,242,669 | B2 * | 8/2012 | Qiu | 362/264 |
| 2009/0129102 | A1 | 5/2009 | Xiao et al. | |
| 2009/0141508 | A1 * | 6/2009 | Peng et al. | 362/373 |
| 2010/0072894 | A1 * | 3/2010 | Shibahara et al. | 362/294 |
| 2010/0164348 | A1 | 7/2010 | Huang et al. | |
| 2011/0089806 | A1 | 4/2011 | Suwa et al. | |
| 2011/0110107 | A1 | 5/2011 | Kawato | |
| 2012/0057352 | A1 * | 3/2012 | Wilcox et al. | 362/373 |
| 2013/0033165 | A1 | 2/2013 | Terazawa | |

FOREIGN PATENT DOCUMENTS

| | | | |
|---|---|---|---|
| CN | 101363610 | A | 2/2009 |
| CN | 201373263 | Y | 12/2009 |
| EP | 2299168 | A1 | 3/2011 |
| EP | 2562476 | A1 | 2/2013 |
| JP | 2010-123527 | | 6/2010 |

OTHER PUBLICATIONS

Extended European Search Report issued in corresponding European Application No. 12182046.8 dated Dec. 19, 2013.

* cited by examiner

*Primary Examiner* — Y My Quach Lee
(74) *Attorney, Agent, or Firm* — Banner & Witcoff, Ltd.

(57) ABSTRACT

In a bulb and a luminaire according to one embodiment, plural fins for thermal radiation are provided on the outer circumferential surface of a main body in which a lighting circuit is attached, a light-emitting module is attached to a module attaching section integrated with the front of the main body, and a cylindrical section that surrounds the light-emitting module is protrudingly provided on a light extracting side.

11 Claims, 7 Drawing Sheets

BULB AND LUMINAIRE

CROSS-REFERENCE TO RELATED APPLICATIONS

This application is based upon and claims the benefit of priority from Japanese Patent Application No. 2011-233747, filed Oct. 25, 2011, the entire contents of which are incorporated herein by reference.

FIELD

Embodiments described herein relate generally to a bulb and a luminaire including the bulb as a light source.

BACKGROUND

In the past, an incandescent lamp and a halogen lamp are used as bulbs of a spotlight, a downlight, and the like. In recent years, a bulb (an LED lamp) including an LED (light-emitting diode) is being spread instead of the bulbs of this type.

In order to replace an existing bulb with the LED lamp, the LED lamp needs to include structure for enabling attachment to an existing luminaire. Therefore, the LED lamp includes a cap attachable to a socket of the existing luminaire and has size (in particular, size in the radial direction) for enabling the attachment to the existing luminaire.

The LED lamp can reduce power consumption. On the other hand, the LED lamp has a problem of aged deterioration in performance due to heat. Therefore, the LED lamp needs to include structure for thermal radiation in order to maintain light-emitting performance and durable life.

As the thermal radiation structure, for example, a thermal radiation fin is known. However, the LED lamp has the limitation in the size in the radial direction as explained above. Therefore, it is difficult to increase the diameter of the LED lamp to secure sufficient area of the thermal radiation fin.

Therefore, there is a demand for development of an LED lamp that can improve thermal radiation performance and a luminaire including the LED lamp.

DETAILED DESCRIPTION

Figure 1:
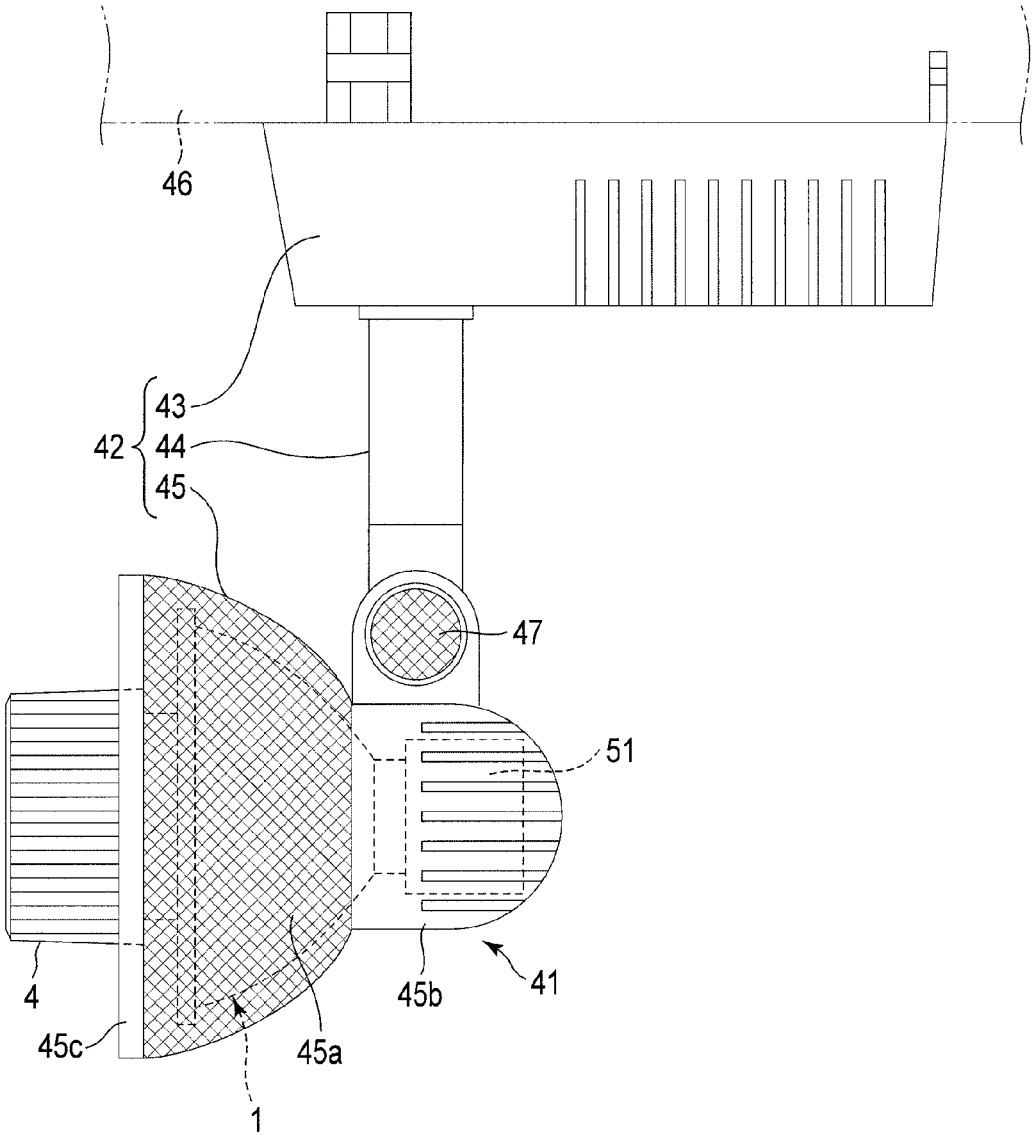
FIG. 1 is a side view of a luminaire according to an embodiment.

In a bulb and a luminaire according to an embodiment, plural fins 18 for thermal radiation are provided on the outer circumferential surface of a main body 17 in which a lighting circuit 7 is attached. A light-emitting module 3 is attached to a module attaching section 11 integrated with the front of the main body 17. A cylindrical section 4 that surrounds the light-emitting module 3 is protrudingly provided on a light extracting side.

Various embodiments will be described hereinafter with reference to the accompanying drawings.

Figure 2:
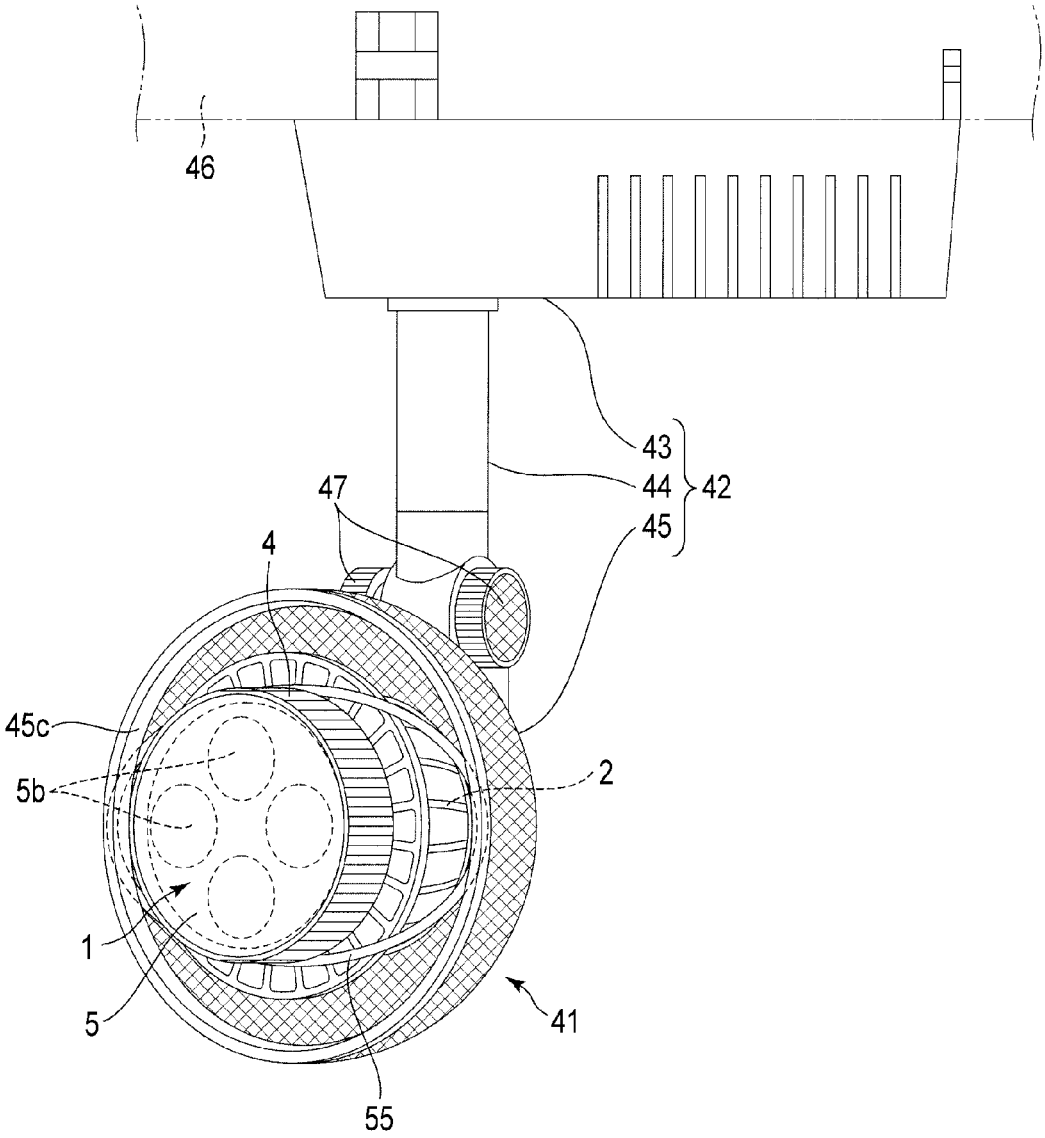
FIG. 2 is a side view of the luminaire in a state in which the direction of a head is changed.
Figure 3:
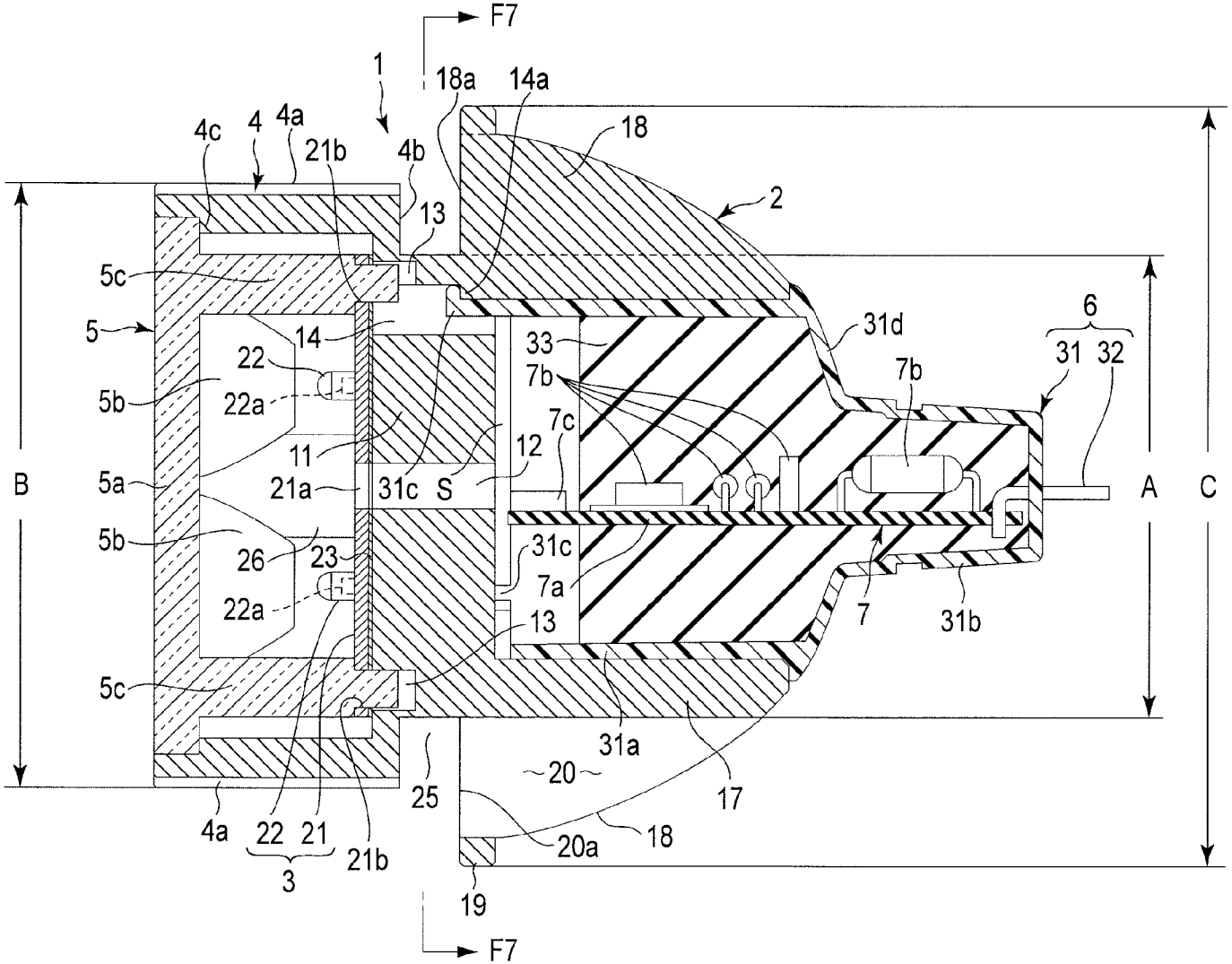
FIG. 3 is a sectional view of a bulb included in the luminaire.

As shown in FIGS. 1 to 3, a bulb 1 includes a bulb main body 2, the light-emitting module 3, the cylindrical section 4 (a thermal radiation section), a light control member 5, a cap 6, and the lighting circuit 7.

The bulb main body 2 is made of metal, for example, made of an aluminum alloy. As shown in FIG. 3, the bulb main body 2 includes the module attaching section 11, the main body 17, and the plural fins 18 (thermal radiation fins).

Figure 5:
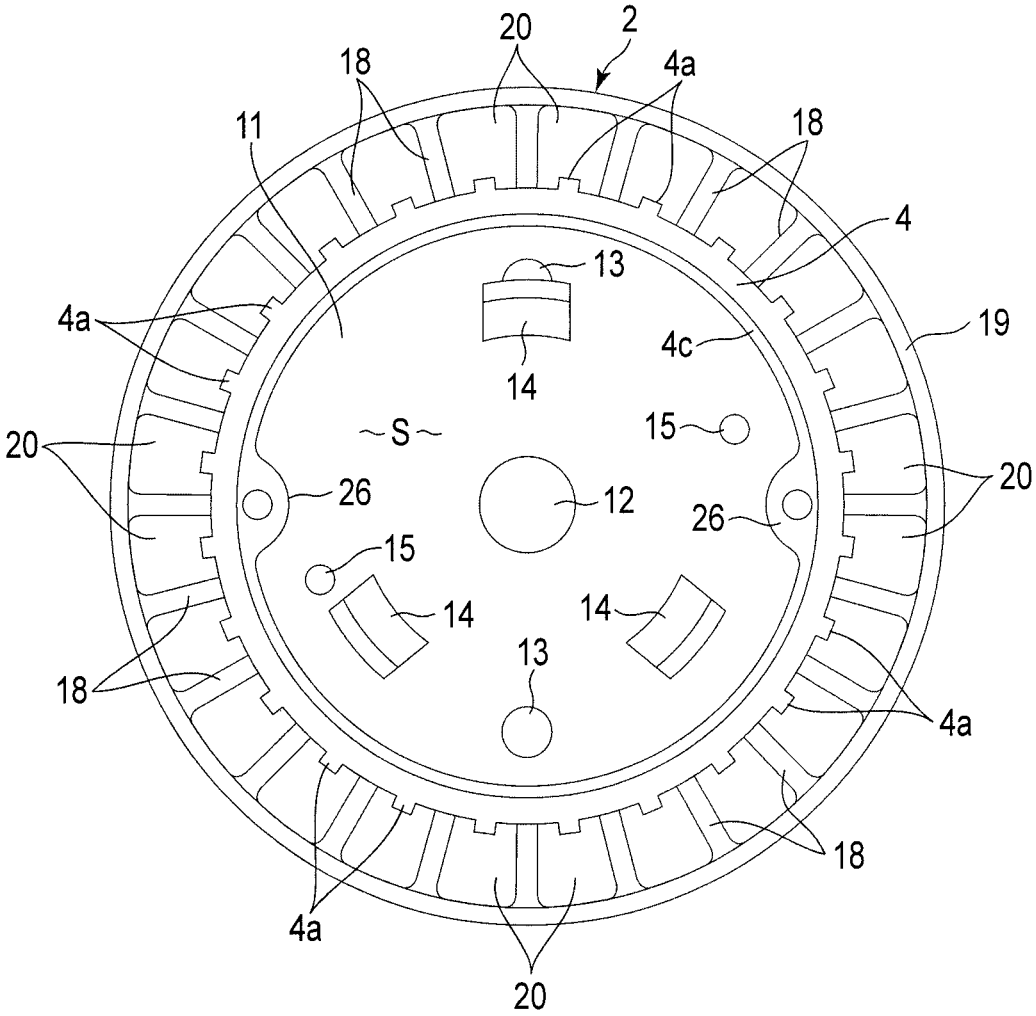
FIG. 5 is a front view of the bulb main body.

As shown in FIG. 5, the module attaching section 11 is substantially circular in plan view. The front surface of the module attaching section 11 is flat. In the module attaching section 11, for example, one wire passing hole 12, plural, for example, two holes 13, plural, for example, three through-holes 14, and plural, for example, two screw holes 15 are provided.

The wire passing hole 12 is drilled to pierce through the center of the module attaching section 11 along an axis of the module attaching section 11. The two holes 13 are provided in a circumferential portion of the module attaching section 11 across the wire passing hole 12 and 180 degrees away from each other in the circumferential direction of the module attaching section 11. The holes 13 are opened on the front surface of the module attaching section 11 to face the inside of the cylindrical section 4.

The three through-holes 14 are drilled in the circumferential portion of the module attaching section 11 at an interval of 120 degrees in the circumferential direction of the module attaching section 11. The through holes 14 are formed by square holes that pierce through the module attaching section 11. The through-holes 14 include step portions 14*a* (representatively shown in FIG. 3) in middle portions thereof. Specifically, the through-holes 14 include front side hole regions ranging from the step portions 14*a* to the front surface of the module attaching section 11 and rear side hole regions ranging from the step portions 14*a* to the rear surface of the module attaching section 11. The front side hole regions are wider than the rear side hole regions. One hole 13 is continuously formed only in the front side hole region of one through-hole 14 (see FIGS. 3 and 5).

The two screw holes 15 are provided in the circumferential portion of the module attaching section 11 across the wire passing hole 12 and 180 degrees apart from each other in the circumferential direction of the module attaching section 11. The screw holes 15 are opened on the front surface of the module attaching section 11 that faces the inside of the cylindrical section 4.

Figure 6:
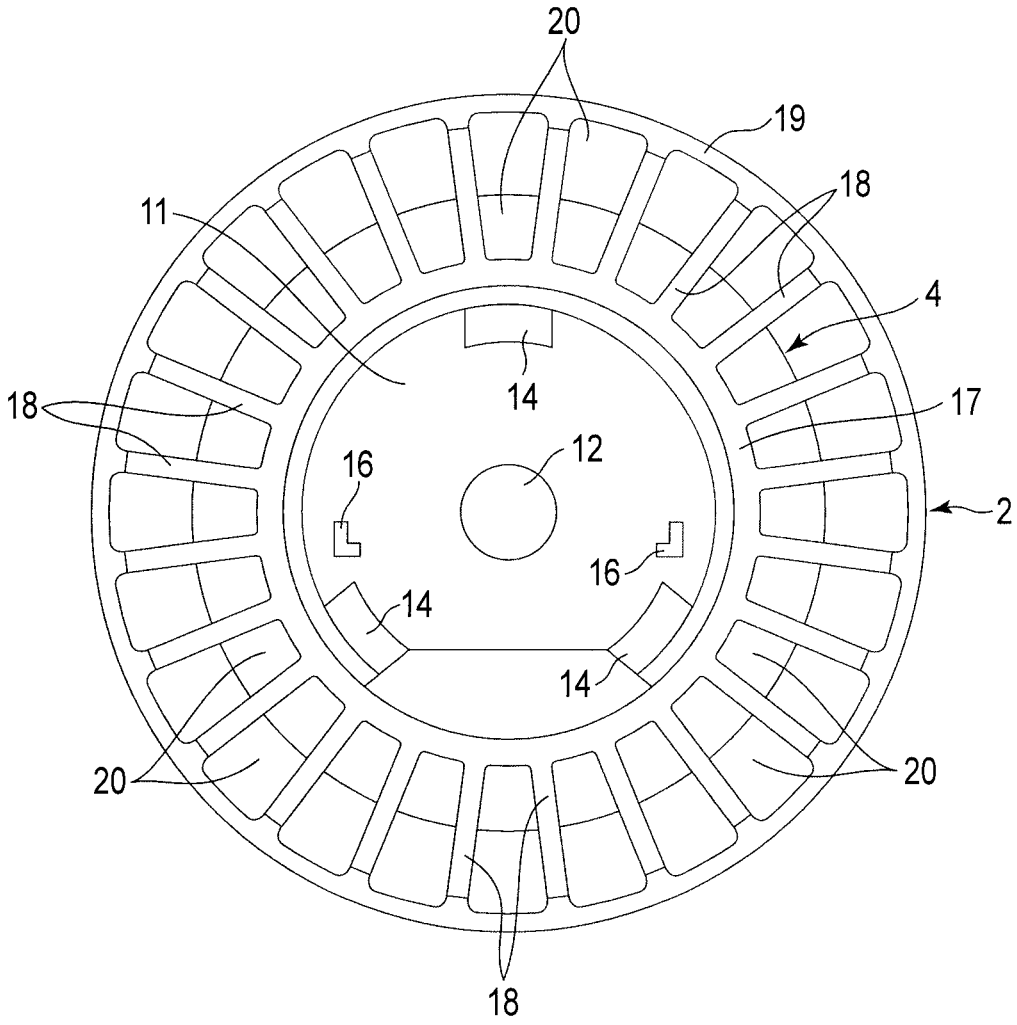
FIG. 6 is a rear view of the bulb main body.

As shown in FIG. 6, a pair of substrate engaging sections 16 are protrudingly provided on the rear surface of the module attaching section 11, which faces the inside of the main body 17, across the wire passing hole 12. The substrate engaging sections 16 are formed by projecting sections formed in an L shape.

The main body 17 is formed in a cylindrical shape. The main body 17 is, for example, integrally molded with the module attaching section 11, whereby the main body 17 is connected to the rear side of the module attaching section 11 to be capable of transferring heat. The inner diameters of the sections of the main body 17 are the same.

A circuit housing section S is formed by the main body 17 and the module attaching section 11. The circuit housing section S is present on the rear side of the module attaching section 11 and opened to the back of the main body 17. The wire passing hole 12 and the though-holes 14 communicate with the circuit housing section S.

The fins 18 are protrudingly provided in a radial shape from the outer circumferential surface of the main body 17. The fins 18 are, for example, integrally molded with the main body 17 to be capable of transferring heat from the main body 17. The fins 18 extend in the same direction as a center axis (not shown in the figure) of the main body 17, i.e., a center axis of the bulb main body 2.

Further, projecting height of the fins 18 with respect to the main body 17 is, for example, larger further on the module attaching section 11 side. Large diameter portions of the fins 18 having the maximum projecting height are connected by an annular frame section 19. The frame section 19 and the fins 18 are integrally molded. The outer diameter of the frame section 19 is a maximum diameter C of the bulb main body 2. The maximum diameter C is a diameter for enabling attachment to an existing luminaire and is the same as the maximum diameter of an existing bulb.

Ventilation grooves 20 are respectively formed among the fins 18 adjacent to one another. The ventilation grooves 20 also extend in the same direction as the center axis. Both ends in the axis direction of the ventilation grooves 20 are opened. An end of the ventilation groove 20 on the module attaching section 11 side forms an opening 20*a* (see FIG. 3) partitioned by ends of the adjacent two fins 18, the frame section 19, and the outer circumferential surfaces of the main body 17.

Figure 7:
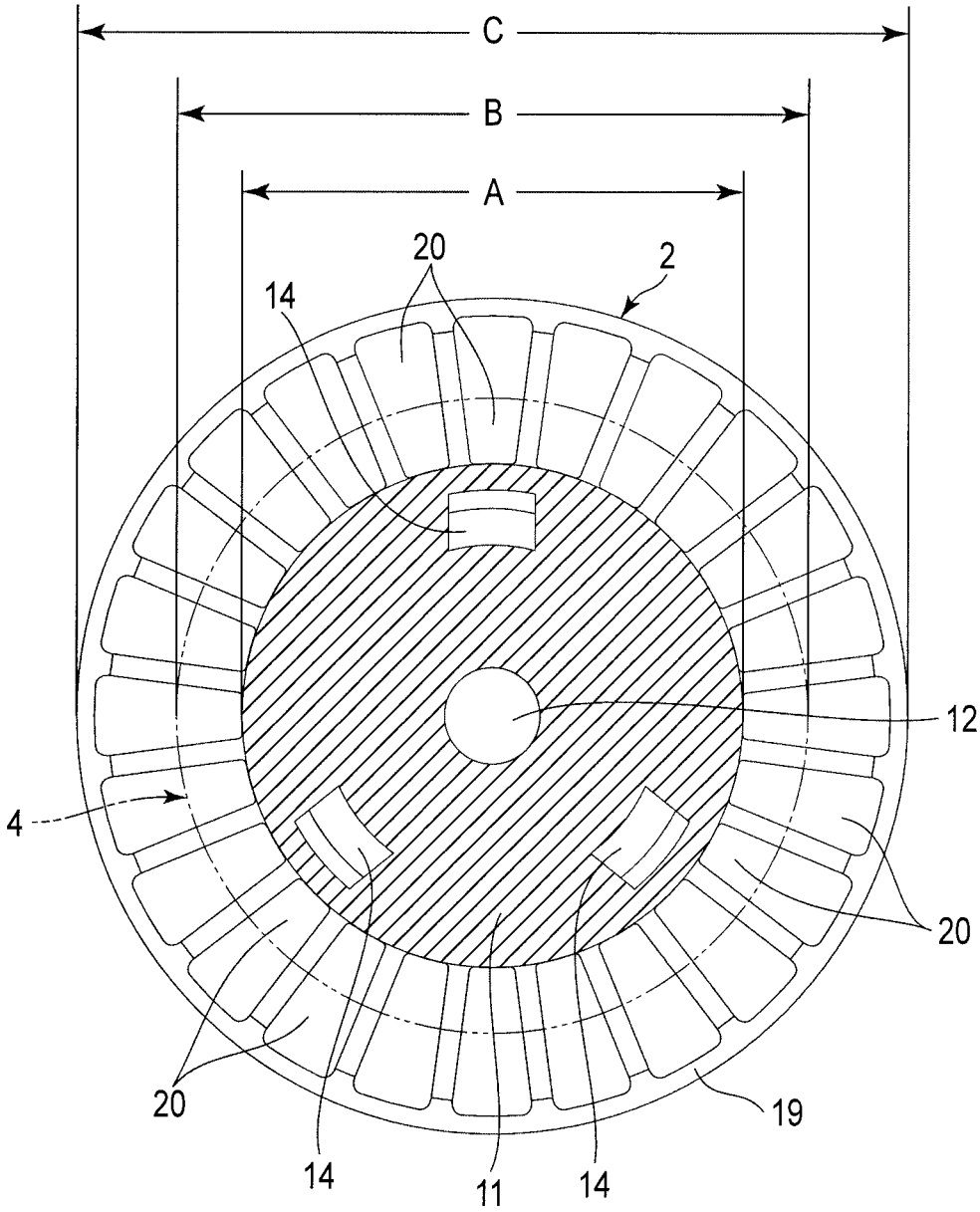
FIG. 7 is a sectional view of the bulb main body taken along line F7-F7 shown in FIG. 3.

The bottoms of the ventilation grooves 20 (i.e., the outer circumferential surface of the main body 17) are parallel to the center axis of the main body 17. A diameter A (see, FIGS. 3 and 7) of an imaginary cylindrical surface formed by connecting the bottoms of the ventilation grooves 20 forms the outer diameter of the main body 17. The bottoms of the ventilation grooves 20 are continuous from the outer circumferential surface of the module attaching section 11 to be flush with the outer circumferential surface.

As shown in FIG. 3, the light-emitting module 3 includes a substrate 21 and light-emitting sections 22.

As the substrate 21, for example, a metal base substrate is used. The shape of the substrate 21 is equivalent to the shape of the below-mentioned inner circumferential surface of the cylindrical section 4. The substrate 21 includes a pair of engaging grooves (not shown in the figure) opened on the circumferential surface thereof. The substrate 21 includes a center hole 21*a* opposed to and communicating with the wire passing hole 12. The substrate 21 includes two holes 21*b* opposed to and communicating with the holes 13. Further, the substrate 21 includes two through-holes (not shown in the figure) opposed to and communicating with the screw holes 15.

The number of the light-emitting sections 22 is at least one, for example, plural, specifically four. The light-emitting sections 22 are attached to the front surface of the substrate 21. For example, LED light-emitting sections of an SMD type are used as the light-emitting sections 22. The light-emitting sections 22 include, on the inside thereof, for example, LEDs 22*a* as light-emitting elements made of semiconductors.

The LED light-emitting section 22 of the SMD type is formed by, for example, mounting at least one LED 22*a* on the front surface of a base made of an insulating material to which a pair of electrodes are attached, electrically connecting the LED 22*a* to the electrodes of the base, attaching a reflector that surrounds the LED 22*a*, and filling, on the inner side of the reflector, translucent resin for sealing the LED 22*a* and the electrodes.

The light-emitting sections 22 are mounted on the substrate 21 by connecting, with flip-chip joining or the like, ends of the electrodes, which are drawn around on the rear surface of the base, to a land of a wiring pattern formed on the front surface of the substrate 21. If, for example, bare chips that emit blue light are used as the LEDs 22*a* in order to emit white illumination light in the light-emitting sections 22, a yellow phosphor is mixed in the translucent resin. The yellow phosphor is excited by blue light made incident thereon and radiates yellow light, which is in a relation of a complementary color with the blue light.

Light emission of an LED is realized by feeing a forward direction current to a p-n junction of a semiconductor. Therefore, the LED is a solid-state element that converts electric energy into direct light. A semiconductor light-emitting element that emits light according to such a light emission principle has an energy saving effect compared with an incandescent lamp that makes a filament incandescent at high temperature through energization and radiates visible light with thermal radiation of the filament.

The light-emitting module 3 is attached to the module attaching section 11 to be capable of transferring heat. Specifically, the light-emitting module 3 is fastened and fixed to the module attaching section 11 in a state in which an insulating sheet 23 is held between the rear surface of the substrate 21 and the front surface of the module attaching section 11. When the light-emitting module 3 is fastened and fixed to the module attaching section 11, not-shown screws inserted through not-shown holes of the substrate 21 and the insulating sheet 23 are screwed in the screw holes 15 of the module attaching section 11. The insulating sheet 23 is formed of an electrically insulative sheet material having satisfactory heat conductivity. The insulating sheet 23 includes the holes (not shown in the figure) through which the screws pass. If the rear surface of the substrate 21 is not made of metal, the insulating sheet can be omitted. The rear surface of the substrate 21 can be set in contact with the front surface of the module attaching section 11. The light-emitting module 3 can be attached to the module attaching section 11 to be capable of transferring heat.

The cylindrical section 4 is made of metal, for example, made of an aluminum alloy. The cylindrical section 4 includes structure for enabling storage of the light control member 5. The cylindrical section 4 is integrally formed with, for example, the distal end and the circumferential portion of the module attaching section 11 of the bulb main body 2, whereby the cylindrical section 4 is connected to the bulb main body 2 to be capable of transferring heat. The cylindrical section 4 is formed in a substantially cylindrical shape and is projected to the opposite side of the main body 17 across the module attaching section 11, i.e., a light emitting direction of the light-emitting module 3. The distal end of the cylindrical section 4 is opened.

The cylindrical section 4 extends straight in the same direction as the center axis of the bulb main body 2. In other words, the cylindrical section 4 is extended coaxially and integrally with the bulb main body 2. Plural projecting portions (fins) 4*a* for thermal radiation are protrudingly provided on the outer circumferential surface of the cylindrical section 4. A surface area (a thermal radiation area) of the cylindrical section 4 is increased by the projecting portions 4*a*. However, the projecting portions 4*a* can be omitted.

An outer diameter B of the cylindrical section 4 is the diameter of an imaginary circle drawn through the distal ends of the projecting portions 4*a*. The outer diameter B is smaller than the maximum diameter C of the bulb main body 2. On the other hand, the outer diameter B of the cylindrical section 4 is larger than the outer diameter A of the main body 17 passing the bottoms of the ventilation grooves 20.

Figure 4:
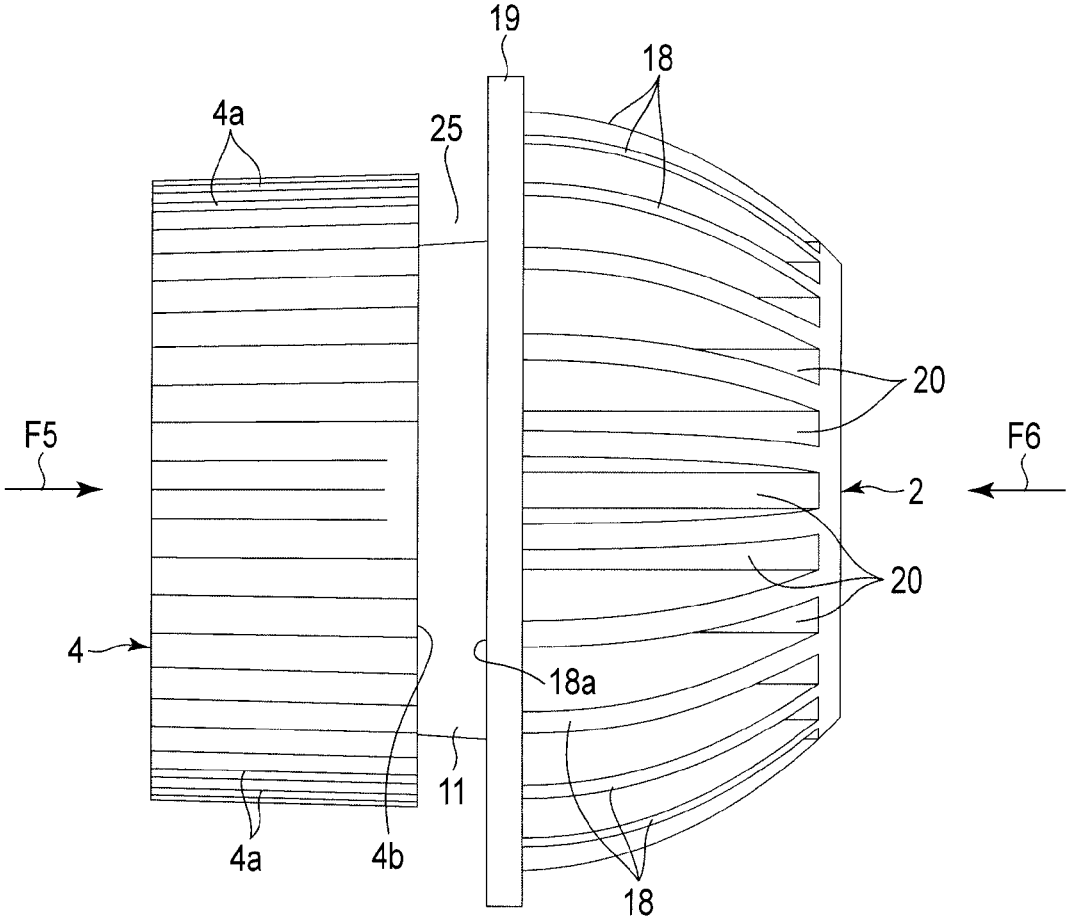
FIG. 4 is a side view of a bulb main body included in the bulb.

As shown in FIGS. 3 and 4, the cylindrical section 4 is connected to the distal end of the module attaching section 11.

Therefore, an end face (a rear surface) 4*b* on the opposite side of a distal end opening of the cylindrical section 4 is away from ends 18*a* on the cylindrical section 4 side of the fins 18. In other words, an annular groove 25 that, for example, continuously extends around the circumferential direction of the module attaching section 11 is provided. The groove 25 is formed by the ends 18*a* on the cylindrical section 4 side of the fins 18, the end face 4*b* of the cylindrical section 4 opposed to the ends 18*a*, and the circumferential surface of the module attaching section 11. As shown in FIG. 3, the entire groove 25 faces the openings 20*a* of the ventilation grooves 20.

As shown in FIG. 3, the module attaching section 11 closes the bottom of the cylindrical section 4. From another viewpoint, the light-emitting module 3 fixed to the module attaching section 11 is housed on the inner side of the cylindrical section 4. As shown in FIGS. 3 and 5, a step 4*c* continuous around the circumferential direction is formed in the inner circumference of the distal end of the cylindrical section 4. On the inner circumferential surface between the step 4*c* and the distal end of the cylindrical section 4, a claw engaging section (not shown in the figure) formed by an annular and shallow groove or the like along the circumferential direction of the inner circumferential surface is formed.

As shown in FIG. 5, for example, two positioning convex portions 26 are integrally provided on the inner circumferential surface of the cylindrical section 4. One ends of the convex portions 26 are provided continuous to the front surface of the module attaching section 11. The other ends of the convex portions 26 are provided continuous to the step 4*c* in the same height position as the step 4*c*. The not-shown engaging grooves of the substrate 21 are engaged with the convex portions 26. The light-emitting module 3 is positioned in the circumferential direction with respect to the module attaching section 11 by the engagement. The light-emitting module 3 is screwed to the module attaching section 11 in this positioned state.

The light control member 5 is a member for controlling luminous intensity distribution of illumination light emitted from the bulb 1. The light control member 5 is attached in the cylindrical section 4 to cover the light-emitting module 3. As shown in FIG. 3, the light control member 5 is integrally molded of translucent resin such as transparent acrylic resin. The light control member 5 includes a front wall 5*a*, light control sections provided in the same number as the light emitting sections 22, for example, plural lens sections 5*b*, and plural, for example, two columns 5*c* for positioning.

The front wall 5*a* is formed in size for fitting the front wall 5*a* in the distal end opening of the cylindrical section 4 with a circumferential portion of the front wall 5*a* set in contact with the step 4*c*. The front wall 5*a* includes, in plural places of the circumferential surface, plural engaging claws (not shown in the figure) having a protrusion shape that engage in the claw engaging section of the cylindrical section 4. The lens sections 5*b* are integrally protrudingly provided, for example, on the rear surface of the front wall 5*a*. Projecting ends forming light incident ends of the lens sections 5*b* are opposed to the light-emitting sections 22 in a state close to the light-emitting sections 22. The distal ends of the two columns 5*c* separated from the front wall 5*a* are formed thinner than the other regions of the columns 5*c*. The distal ends of the columns 5*c* can be inserted into the holes 21*b* of the substrate 21 of the light-emitting module 3 and the holes 13 of the module attaching section 11. Regions other than the distal ends of the columns 5*c* have a diameter larger than the diameter of the holes 21*b*.

The light control member 5 is fit in the inner side of the cylindrical section 4 by inserting and fitting the distal ends of the two columns 5*c* in the holes 21*b* and the holes 13, setting steps between the distal ends of the columns 5*c* and regions thicker than the distal ends in contact with the front surface of the substrate 21 around the holes 21*b*, and engaging the engaging claws of the front wall 5*a* in the claw engaging section of the cylindrical section 4.

The steps between the distal ends of the columns 5*c* and the regions thicker than the distal ends are set in contact with the circumferences of the holes 21*b* of the substrate 21, whereby the position in the height direction (a direction in which a center axis extends) of the light control member 5 with respect to the cylindrical section 4 is determined. At the same time, the distal ends of the columns 5*c* are fit in the holes 21*b*, whereby the position of the light control member 5 with respect to the substrate 21 in a direction orthogonal to the center axis is determined. Consequently, the light-emitting sections 22 and the lens sections 5*b* are positioned to be right opposed to each other.

The holes 13 of the module attaching section 11 and the distal ends of the columns 5*c* inserted into the holes 13 are bonded by a not-shown adhesive. Consequently, even if the engaging claws of the light control member 5 and the claw engaging section of the cylindrical section 4 are disengaged, the light control member 5 is prevented from coming off the cylindrical section 4. The light control sections of the light control member 5 are not limited to the lens sections 5*b* and can also be formed by prisms, reflecting mirrors, or the like.

As shown in FIG. 3, the cap 6 includes a cap base 31 made of an insulating material, for example, synthetic resin and two cap pins 32 (only one is shown in the figure).

The cap base 31 includes a base section 31*a*, a cap section 31*b*, and connecting sections 31*c* provided in the same number as the through-holes 14 (only two connecting sections 31*c* are shown in FIG. 3).

The base section 31*a* is formed in a cylindrical shape. The base section 31*a* is set in contact with the inner circumferential surface of the circuit housing section S and fit in the circuit housing section S. One end of the base section 31*a* is opened and includes an end wall 31*d* at the other end. The cap section 31*b* is protrudingly provided to the outer side from the end wall 31*d*. The cap section 31*b* and the end wall 31*d* close the other end of the base section 31*a*.

The connecting sections 31*c* are integrally provided at the opened one end of the base section 31*a* and projected in the direction opposite to the cap section 31*b*. The connecting sections 31*c* can be elastically deformed with base portions thereof as fulcrums. The connecting sections 31*c* include distal ends formed in a claw shape. The distal ends can be inserted through rear side hole regions from the step portions 14*a* of the through-holes 14 to the rear surface of the module attaching section 11. The connecting sections 31*c* are inserted through the rear side hole regions of the through holes 14 and the distal ends of the connecting sections 31*c* are hooked to the step portions 14*a* of the through-holes 14, whereby the cap 6 is attached to the bulb main body 2.

The lighting circuit 7 is formed by mounting plural circuit components 7*b* on a circuit substrate 7*a*. The lighting circuit 7 is incorporated in the cap base 31. In other words, the lighting circuit 7 is housed in the circuit housing section S. The circuit substrate 7*a* is supported by the cap base 31 to be parallel to a center axis (not shown in the figure) of the cap base 31. A part of the circuit substrate 7*a* is disposed in the cap section 31*b*. The other end of the circuit substrate 7*a* is engaged with the substrate engaging sections 16 and supported. The circuit components 7*b* include components that involve heat generation such as a capacitor and an electric connector 7*c* on a power supply side.

The circuit substrate 7*a* is disposed to be substantially perpendicular to the rear surface of the module attaching section 11. Consequently, it is possible to set the inner and outer diameters of the main body 17 small compared with a configuration in which the circuit substrate 7*a* is disposed such that a plate surface of the circuit substrate 7*a* is parallel to the rear surface of the module attaching section 11. Consequently, it is possible to increase the projecting height of the fins 18 with respect to the main body 17 and increase a thermal radiation area of the bulb main body 2 according to the increase in the projecting height.

The cap pins 32 are attached to pierce through an end wall of the cap section 31*b*. The cap pins 32 are electrically connected to the circuit board 7*a* in the cap section 31*b*.

Silicone resin 33 (a filler) having high heat conductivity is filled on the inside of the cap 6. Most of the lighting circuit 7 is sealed by the silicone resin 33. The electric connector 7*c* on the power supply side is disposed on the outside of the silicone resin 33. An electric connector on a power receiving side (not shown in the figure) is connected to the electric connector 7*c* on the power supply side. The electric connector on the power receiving side is attached to one end of a not-shown insulating coating electric wire which is passed through the wire passing hole 12. The other end of the electric wire is electrically connected to the substrate 21 of the light-emitting module 3.

The size and the shape of the cap section 31*b*, the size and the shape of the cap pins 32, and the like are the same as the size and the shape of the cap of the existing bulb. Total length of the length in a direction in which the center axis of the bulb main body 2 extends and the length in a direction in which a center axis of the cap section 31*b* projected from the bulb main body 2 is the same as that of the existing bulb. The existing bulb refers to, for example, an incandescent lamp or a halogen lamp attached to the existing luminaire.

A luminaire, for example, a spotlight 41 including, as a light source, the bulb 1 having the structure explained above is explained with reference to FIGS. 1 and 2.

The spotlight 41 includes a luminaire main body 42, a socket 51, the bulb 1, and a bulb holder 55.

The luminaire main body 42 includes a main body base 43, a main body support 44, and a main body head 45.

The main body base 43 is attached to a luminaire setting section such as a wiring rail 46 mounted on a ceiling, for example. The main body support 44 is protrudingly provided, for example, at one end of the main body base 43. The main body support 44 is coupled to the main body base 43. The main body support 44 can be pivoted about an axis by manual operation and can be retained in a stationary state in a pivoting adjustment position thereof by a frictional engaging force.

The main body head 45 is coupled to the distal end of the main body support 44. The main body support 44 and the main body head 45 are connected by a connecting screw 47 that can be manually operated. An angle in the up down direction of the main body head 45 with respect to the main body support 44 can be adjusted by loosening the connecting screw 47. The main body head 45 adjusted to a desired angle is held by tightening the connecting screw 47. Therefore, the main body head 45 can be faced in an arbitrary direction by the pivoting operation about the axis of the main body support 44 and the angle adjustment in the up down direction about the connecting screw 47.

As shown in FIG. 1, the main body head 45 includes a light-source disposing section 45*a* opened on the front surface and a socket disposing section 45*b* continuously provided on the opposite side of the opened front surface of the light-source disposing section 45*a*. The light-source disposing section 45*a* is larger than the bulb main body 2 of the bulb 1 and can house the bulb main body 2. The light-source disposing section 45*a* has air permeability. Therefore, the light-source disposing section 45*a* is formed in, for example, a mesh shape.

The socket 51 is disposed, for example, in the socket disposing section 45*b* of the main body head 45. The cap pins 32 of the bulb 1 are detachably inserted into and connected to the socket 51. A not-shown power supply line extending from the main body base 43 to the socket 51 is wired on the inside of the main body head 45 and wired through the inside of the main body support 44 piercing through the light source disposing section 45*a*.

The luminaire main body 42 is not limited to the structure explained above. The luminaire main body 42 may have a configuration in which a region on the cap 6 side of the bulb main body 2 and the cylindrical section 4 are exposed to the atmosphere to surround and support the end on the maximum diameter portion side of the bulb main body 2. In other words, the luminaire main body 42 may support the bulb 1 while causing the bulb 1 to pierce through the luminaire main body 42. In this case, the power supply line and the socket 51 connected to the distal end of the power supply line are disposed on the outside of the luminaire main body 42. Therefore, the connection of the socket 51 and the cap 6 of the bulb 1 only has to be performed on the outside.

The bulb holder 55 is formed in an elliptical shape by an elastically deformable wire rod such as a metal wire. The bulb holder 55 is disposed to transverse the opening of the main body head 45. The bulb holder 55 engages with the bulb 1 supported by the main body head 45 and supports the bulb 1 not to come off the main body head 45.

The bulb 1 is put through the opening on the front surface of the main body head 45 with the cap 6 in the lead and inserted into the main body head 45. The cap 6 of the inserted bulb 1 is inserted into the socket 51. Consequently, the cap pins 32 are inserted into a not-shown pin bearing fitting included in the socket 51. The bulb 1 is electrically and mechanically connected to the socket 51. The cylindrical section 4 of the bulb 1 supported by the main body head 45 projects to the outside from the opening on the front surface of the main body head 45.

In this way, the bulb 1 is disposed in a state in which the cap 6 is connected to the socket 51, the bulb main body 2 is supported by the luminaire main body 42, and the cylindrical section 4 is projected from the main body head 45 of the luminaire main body 42. In this state, the bulb holder 55 is attached to the opening on the front surface of the main body head 45.

This attachment is performed by, in a state in which the bulb holder 55 is elastically deformed into a substantially circular shape, while putting the cylindrical section 4 through the inner side of the bulb holder 55, pushing in the bulb holder 55 until the bulb holder 55 comes into contact with the ends 18*a* of the fins 18 of the bulb main body 2 and releasing a force applied to the bulb holder 55.

Consequently, as the bulb holder 55 is about to return to the original elliptical shape, the bulb holder 55 is disposed to transverse the opening on the front surface of the main body head 45. Both ends in a direction in which a major axis of the ellipse extends are caught by an opening edge 45*c* of the front surface of the main body head 45 from the inner side of the main body head 45. At the same time, the bulb holder 55 gets into the groove 25 of the bulb 1 to hold the module attaching section 11 of the bulb 1 in the radial direction thereof. Therefore, the bulb holder 55 functions as a stopper to prevent the bulb 1 supported by the socket 51 from dropping.

The bulb 1 can be detached from the main body head 45 of the luminaire main body 42 according to a procedure opposite to the attaching procedure for the bulb 1 explained above. In such attaching and detaching operation for the bulb 1, even if a finger of an operator does not reach between the main body head 45 and the bulb main body 2, the operator can grip the cylindrical section 4 of the bulb 1 and perform attaching and detaching work for the socket 51.

When a not-shown lighting switch is turned on, electric power is supplied to the lighting circuit 7 through the socket 51 and the cap 6 connected to the socket 51. An output of the lighting circuit 7 is supplied to the LEDs 22*a* of the light-emitting sections 22. Consequently, since the LEDs 22*a* emit light, white light emitted from the light-emitting sections 22 passes through the lens sections 5*b* to change to predetermined distributed light in a light usage direction. The white light is emitted, for example, in a beam shape.

The LEDs 22*a* generate heat in such a lighting state. Most of the heat is transferred to the module attaching section 11 of the bulb main body 2 through the substrate 21 and the insulating sheet 23. Further, the heat of the module attaching section 11 is transferred to the cylindrical section 4 of the bulb 1 projected to the outside of the main body head 45 of the luminaire main body 42 and is emitted to the atmosphere from the outer surface of the cylindrical section 4. At the same time, the heat of the module attaching section 11 is transferred to the fins 18 through the main body 17 of the bulb main body 2 and emitted to the outside of the bulb main body 2. In this case, since the main body head 45, which houses the bulb main body 2, has air permeability, the heat emitted into the main body head 45 from the bulb main body 2 is suppressed from being filled in the main body head 45 and is emitted to the atmosphere through the main body head 45.

As explained above, according to this embodiment, since the lit bulb 1 can be naturally cooled by the air, it is possible to suppress a deficiency that the temperature of the LEDs 22*a* excessively rises. As a result, it is possible to suppress deterioration in performance, a decrease in durable life, and the like of the LEDs 22*a*.

As explained above, the bulb 1 according to this embodiment has a relatively large thermal radiation area for realizing the natural air-cooling. The large thermal radiation area can be secured because of a reason explained below.

The bulb 1 includes, besides the bulb main body 2 in which the light-emitting module 3 is disposed to be capable of transferring heat, the cylindrical section 4 made of metal that projects in the light emitting direction of the light-emitting module 3 and in which the light-emitting module 3 is housed. The cylindrical section 4 is connected to the bulb main body 2 made of metal to be capable of transferring heat. In other words, the bulb 1 includes the cylindrical section 4 and the bulb main body 2, which receive the transfer of the heat of the LEDs 22*a* and function as thermal radiation sections, respectively in the light emitting direction and the opposite direction of the light emitting direction with respect to the light-emitting module 3. Consequently, it is possible to increase the thermal radiation area of the bulb 1 compared with a bulb not including a component equivalent to the cylindrical section 4.

In particular, the main body 17 of the bulb main body 2 includes the plural fins 18 for thermal radiation in the outer circumference of the main body 17. The diameter of the bulb main body 2 is larger than the diameter of the cylindrical section 4. Further, the diameter of the main body 17 passing the bottoms of the ventilation grooves 20 formed among the adjacent fins 18 is smaller than the diameter of the cylindrical section 4. Consequently, it is possible to secure large projecting height of the fins 18 with respect to the main body 17 and increase the surface area (the thermal radiation area) of the fins 18 according to the large projecting height of the fins 18.

As explained above, the bulb 1 in which the large thermal radiation area is secured in this way can emit the heat generated by the LEDs 22*a* to the atmosphere from the cylindrical section 4 and the fins 18 in a state in which the bulb 1 is lit. Therefore, it is possible to improve the thermal radiation performance by the natural air-cooling.

Further, the bottoms of the ventilation grooves 20 among the adjacent fins 18 are parallel to the center axis of the main body 17. In other words, the outer diameters of the sections of the main body 17 are the same. On the other hand, the fins 18 include the structure wider further on the distal end side thereof. Therefore, it is possible to secure the large projecting height of the fins 18 with respect to the main body 17 over the entire length of the fins 18. A larger thermal radiation area of the fins 18 is secured according to the large projecting height of the fins 18. It is possible to further improve the thermal radiation performance by the natural air-cooling.

Moreover, in the bulb 1, the bulb main body 2 and the cylindrical section 4 are integrally formed. Therefore, compared with a configuration in which the bulb main body 2 and the cylindrical section 4 are separate and are connected to be integrated, thermal resistance between the bulb main body 2 and the cylindrical section 4 is small and heat transfer performance from the bulb main body 2 to the cylindrical section 4 is high. Therefore, it is possible to further improve the thermal radiation performance by the natural air-cooling.

Furthermore, in the bulb 1, the cylindrical section 4 is away from the ends 18*a* on the cylindrical section side of the fins 18 and connected to the circumferential surface of the module attaching section 11. At the same time, the ventilation grooves 20 face the groove 25 extending in the circumferential direction of the module attaching section 11. Therefore, although the outer diameter B of the cylindrical section 4 is larger than the diameter (the outer diameter) A of the main body 17 passing the bottoms of the ventilation grooves 20 among the adjacent fins 18, bottom side regions of the ventilation grooves 20 are not closed by the cylindrical section 4 at the opened ends of the ventilation grooves 20. Consequently, the air can smoothly circulate through the ventilation grooves 20 and the groove 25 communicating with the ventilation grooves 20. It is possible to further improve the thermal radiation performance by the natural air-cooling.

In the bulb 1, the circumferential surface of the module attaching section 11 and the bottoms of the ventilation grooves 20 are continuous to be flush with each other. Consequently, the bottom side regions of the ventilation grooves 20 are prevented from being covered with the circumferential portion of the module attaching section 11 at the opened ends of the ventilation grooves 20 to disturb the air flowing through the ventilation grooves 20 and the groove 25 communicating with the ventilation grooves 20. Therefore, it is possible to more smoothly circulate the air through the ventilation grooves 20 and the groove 25 communicating with the ventilation grooves 20. It is possible to further improve the thermal radiation performance by the natural air-cooling.

Further, the bulb 1 includes the sealing resin 33 having satisfactory heat conductivity that seals the circuit components 7*b*. The base section 31*a* of the cap base 31, in which the sealing resin 33 is filled, is in contact with the inner circumferential surface of the main body 17. Therefore, the heat of the heated circuit components 7*b* is transferred to the fins 18 through the sealing resin 33 and the base section 31*a* and emitted to the atmosphere from the fins 18. Consequently, it is possible to suppress the temperature of electric components, which generate heat, from excessively rising.

In the bulb and the luminaire according to the embodiment explained above, the plural fins 18 for thermal radiation are provided on the outer circumferential surface of the main body 17, in which the lighting circuit 7 is attached, the light-emitting module 3 is attached to the module attaching section 11 integrated with the front of the main body 17, and the cylindrical section 4 that surrounds the light-emitting module 3 is provided on the light extracting side. Therefore, it is possible to improve thermal radiation properties without changing the size of the bulb 1.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

According to one embodiment, a bulb includes: a bulb main body made of metal including a module attaching section, a cylindrical main body connected to the rear side of the attaching section to be capable of transferring heat, and a plurality of fins extending in the same direction as a center axis of the main body and protrudingly provided from the outer circumferential surface of the main body; a light-emitting module including a substrate and a light-emitting section attached to the substrate, the light-emitting module being disposed to be capable of transferring heat to the module attaching section; a cylindrical section made of metal configured to have an outer diameter smaller than a maximum diameter of the bulb main body and larger than an outer diameter of the main body passing the bottoms of ventilation grooves formed among the fins adjacent to one another, house the light-emitting module, and project in a light-emitting direction of the light-emitting module and connected to the bulb main body to be capable of transferring heat; a lighting circuit electrically connected to the light-emitting module; and a cap attached to the bulb main body and configured to supply electric power to the lighting circuit.

According to this embodiment, iron, a copper alloy, titanium, an aluminum alloy, or the like can be used as the metal forming the bulb main body and the cylindrical section. It is desirable to use the aluminum alloy because the aluminum alloy is relatively low in material cost, light in weight, and excellent in heat conductivity. The bulb main body and the cylindrical section may be either integral or separate. Fins can be provided in the outer circumference of the cylindrical section as well. Consequently, it is possible to expect further improvement of the thermal radiation properties. Further, in the cylindrical section, the outer diameters of the sections can be set the same. However, the cylindrical section is not limited to this. For example, the outer diameter may gradually decrease or increase toward the projecting end side of the cylindrical section.

According to this embodiment, the module attaching section and the main body are desirably integrally molded in securing higher heat transfer performance. However, the module attaching section and the main body are not limited to this and may be separate. Further, the module attaching section is not limited to be provided to form the bottom of the cylindrical section. The module attaching section may project from the bottom of the cylindrical section to the distal end side.

According to this embodiment, the light-emitting section of the light-emitting module refers to, for example, a light-emitting section of an SMD type, a COB type, or the like including at least one light-emitting element formed of a bare chip of an LED. As the light-emitting element, a semiconductor light-emitting element involving heat generation in a light-emitting state, for example, a bare chip of an LED can be suitably used. Further, as the substrate of the light-emitting module, for example, a metal base substrate obtained by superimposing an insulating layer on a metal base, a resin substrate including at least one layer of an insulating material, or a ceramics substrate can be used.

The bulb according to this embodiment includes the cylindrical section made of metal that projects in a light-emitting direction of the light-emitting module and in which the light-emitting module is housed. The cylindrical section is connected to the bulb main body made of metal to be capable of transferring heat. Consequently, the thermal radiation area of the bulb can be increased compared with a bulb not including a component equivalent to the cylindrical section. The bulb includes the plural fins for thermal radiation on the outer circumferential surface of the main body of the bulb main body. The diameter of the main body of the bulb main body passing the bottoms of the ventilation grooves formed among the adjacent fins is smaller than the diameter of the cylindrical section. Consequently, large projecting height of the fins with respect to the main body can be secured. The surface area of the fins can be increased according to the large projecting height of the fins.

Therefore, since heat generated by the light-emitting element in a state in which the bulb is lit can be efficiently emitted to the atmosphere from the cylindrical section and the fins, it is possible to improve the thermal radiation performance by the natural air-cooling.

In a bulb according to another embodiment, the bottoms of the ventilation grooves are parallel to the center axis of the main body. In other words, according to this embodiment, the outer diameters of the sections of the main body are the same. Therefore, compared with a configuration in which the main body has a larger diameter further on the distal end side thereof, it is possible to secure large projecting height of the fins with respect to the main body over the entire length of the fins. Therefore, it is possible to further improve the thermal radiation performance by the natural air-cooling.

In a bulb according to still another embodiment, the bulb main body and the cylindrical section are integrally formed. For example, the bulb main body and the cylindrical section can be machined from a metal material and integrally formed or can be integrally formed by die-cast molding or the like.

According to this embodiment, it is possible to reduce thermal resistance between the bulb main body and the cylindrical section compared with a configuration in which the bulb main body and the cylindrical section are separate and connected to be integrated. It is possible to improve heat transfer performance from the bulb main body to the cylindrical section. Therefore, it is possible to further improve the thermal radiation performance by the natural air-cooling.

In a bulb according to still another embodiment, the cylindrical section is apart from the end on the cylindrical section side of the fins and connected to the module attaching section. The cylindrical section includes a groove formed by the end face of the cylindrical section opposed to the fins, the ends on the cylindrical section side of the fins, and the circumferential surface of the module attaching section. The ventilation grooves face the groove.

According to this embodiment, the groove extending in the circumferential direction of the module attaching section may be continuous without being broken over the entire circumference of the module attaching section or may be provided to be partitioned, for example, at every 180 degrees in the circumferential direction of the module attaching section.

According to this embodiment, although the diameter of the cylindrical section is larger than the outer diameter of the main body passing the bottoms of the ventilation grooves among the adjacent fins, the opened ends of the ventilation grooves are not closed by the cylindrical section. Consequently, it is possible to smoothly circulate the air through the ventilation grooves and the groove communicating with the ventilation grooves. It is possible to further improve the thermal radiation performance by the natural air-cooling.

In a bulb according to still another embodiment, the circumferential surface of the module attaching section and the bottoms of the ventilation grooves are continuous to be flush with each other.

According to this embodiment, the bottom side regions of the ventilation grooves are prevented from being covered with the circumferential portion of the module attaching section at the opened ends of the ventilation grooves to disturb the air flowing through the ventilation grooves and the groove communicating with the ventilation grooves. Therefore, it is possible to more smoothly circulate the air through the ventilation grooves and the groove communicating with the ventilation grooves. It is possible to further improve the thermal radiation performance by the natural air-cooling.

Further, a luminaire according to an embodiment includes: a luminaire main body; a socket disposed on the inside or the outside of the luminaire main body; and the bulb according to the embodiment explained above disposed in the luminaire main body in a state in which the cap is connected to the socket, the bulb main body is supported by the luminaire main body, and the cylindrical section is projected from the luminaire main body.

The luminaire according to this embodiment can be applied to luminaires such as a spotlight and a downlight. According to this embodiment, it is possible to provide a luminaire including a bulb that can improve the thermal radiation performance by the natural air-cooling.

What is claimed is:

1. A bulb comprising:

a cylindrical main body including a module attaching section at one end in a bulb axis direction;

a plurality of thermal radiation fins protruding from an outer circumferential surface of the cylindrical main body in a radial direction;

a plurality of ventilation grooves formed among the plurality of thermal radiation fins;

a light-emitting module attached to the module attaching section;

a thermal radiation section connected to the one end of the cylindrical main body, projecting in the light-emitting direction and surrounding the light-emitting module in the light-emitting direction; and a groove continuous to one end of each of the plurality of ventilation grooves in the bulb axis direction and formed between the thermal radiation section and the one end of each of the plurality of fins, wherein an outer diameter of the thermal radiation section is smaller than a maximum outer diameter of an imaginary circle formed by outer edges of the plurality of thermal radiation fins, wherein an outer diameter of the main body is smaller than the outer diameter of the thermal radiation section, and wherein the thermal radiation section is spaced apart from the one end of each of the plurality of fins.

2. The bulb according to claim 1, further comprising:

a lighting circuit electrically connected to the light-emitting module; and a cap attached to another end of the main body in the bulb axis direction, the cap configured to supply electric power to the lighting circuit.

3. The bulb according to claim 1, further comprising:

a lighting circuit electrically connected to the light-emitting module and housed in the main body; and a thermally conductive filler configured to seal at least a part of the lighting circuit in the main body.

4. The bulb according to claim 1, wherein the outer circumferential surface of the main body is parallel to the bulb axis of the main body.

5. The bulb according to claim 1, wherein the plurality of fins are integrally formed with the main body.

6. The bulb according to claim 1, wherein the thermal radiation section is integrally formed with the main body.

7. The bulb according to claim 1, wherein bottom surfaces of the plurality of ventilation grooves are continuous and flush with a circumferential surface of the module attaching section.

8. A bulb comprising:

a cylindrical main body including a module attaching section at one end in a bulb axis direction;

a plurality of fins integrally formed with the main body to protrude from an outer circumferential surface of the main body in a radial direction;

a plurality of ventilation grooves formed among the plurality of thermal radiation fins;

a light-emitting module attached to the module attaching section;

a thermal radiation section integrally formed with the main body, projecting from the main body in a light-emitting direction on one end side in the bulb axis direction, and surrounding the light-emitting module in the light-emitting direction;

a groove continuous to one end of each of the plurality of ventilation grooves in the bulb axis direction and formed between the thermal radiation section and the one end of each of the plurality of fins;

a lighting circuit electrically connected to the light-emitting module and housed in the main body;

a cap attached to the other end in the bulb axis direction of the main body and configured to supply electric power to the lighting circuit; and a thermally conductive filler configured to seal at least a part of the lighting circuit in the main body, wherein an outer diameter of the thermal radiation section is smaller than a maximum outer diameter of an imaginary circle formed by outer edges of the plurality of thermal radiation fins, wherein an outer diameter of the main body is smaller than the outer diameter of the thermal radiation section, and wherein the thermal radiation section is spaced apart from the one end of each of the plurality of fins in the bulb axis direction.

9. The bulb according to claim 8, wherein the maximum diameter of the plurality of fins is defined based on projecting heights of the plurality of fins.

10. The bulb according to claim 8, wherein the outer circumferential surface of the main body is parallel to a center axis of the main body.

11. A luminaire comprising:

a luminaire main body;

a socket disposed in the luminaire main body; and a bulb connected to the socket, wherein the bulb includes:

a cylindrical main body including a module attaching section at one end in a bulb axis direction;

a plurality of fins integrally formed with the main body to protrude from an outer circumferential surface of the main body in a radial direction;

a plurality of ventilation grooves formed among the plurality of thermal radiation fins;

a light-emitting module attached to the module attaching section;

a thermal radiation section integrally formed with the main body, projecting from the luminaire main body in a light-emitting direction on one end side in the bulb axis direction, and surrounding the light-emitting module;

a groove continuous to one end of each of the plurality of ventilation grooves in the bulb axis direction and formed between the thermal radiation section and the one end of each of the plurality of fins;

a lighting circuit electrically connected to the light-emitting module and housed in the main body; and a cap attached to the other end in the bulb axis direction of the main body and connected to the socket configured to supply electric power to the lighting circuit; and a thermally conductive filler configured to seal at least a part of the lighting circuit in the main body, wherein an outer diameter of the thermal radiation section is smaller than a maximum outer diameter of an imaginary circle formed by outer edges of the plurality of thermal radiation fins, wherein an outer diameter of the main body is smaller than the outer diameter of the thermal radiation section, and wherein the thermal radiation section is spaced apart from the one end of each of the plurality of fins in the bulb axis direction.

* * * * *